US008127508B2

(12) United States Patent
Mühlebach

(10) Patent No.: US 8,127,508 B2
(45) Date of Patent: Mar. 6, 2012

(54) DEVICE FOR SEPARATING REGIONS OF A SPACE

(75) Inventor: Moritz Mühlebach, Dietlikon (CH)

(73) Assignee: Proverum AG, Baar (CH)

( * ) Notice: Subject to any disclaimer, the term of this patent is extended or adjusted under 35 U.S.C. 154(b) by 479 days.

(21) Appl. No.: 12/278,235

(22) PCT Filed: Mar. 1, 2006

(86) PCT No.: PCT/EP2006/001861

§ 371 (c)(1),
(2), (4) Date: Aug. 4, 2008

(87) PCT Pub. No.: WO2007/087829

PCT Pub. Date: Aug. 9, 2007

(65) Prior Publication Data

US 2009/0020242 A1 Jan. 22, 2009

(30) Foreign Application Priority Data

Feb. 2, 2006 (DE) ..... 10 2006 005 261

(51) Int. Cl.
*E04H 1/00* (2006.01)

(52) U.S. Cl. ..... 52/241; 52/646; 52/481.2; 52/64; 52/657

(58) Field of Classification Search ..... 52/646, 52/481.1, 481.2, 64, 645, 657, 150, 127.2, 52/693, 79.5, 241; 248/351, 354.1, 200.1
See application file for complete search history.

(56) References Cited

U.S. PATENT DOCUMENTS 253,520 A * 2/1882 Du Bois ..... 160/374
2,591,352 A * 4/1952 Harbison ..... 52/291
2,856,646 A * 10/1958 Latimer et al. ..... 52/223.6
3,033,330 A * 5/1962 Fowles et al. ..... 52/127.11
(Continued)

FOREIGN PATENT DOCUMENTS

NL 1004359 C1 4/1998
(Continued)

OTHER PUBLICATIONS

International Search Report for International Application No. PCT/EP2006/001861.

*Primary Examiner* — Robert Canfield
*Assistant Examiner* — Jessie Fonseca
(74) *Attorney, Agent, or Firm* — Roberts Mlotkowski Safran & Cole, P.C.; David S. Safran

(57) ABSTRACT

A device (1) for separating regions of a space, with at least one ceiling rail (3) for pressing on the ceiling (4) of the space, with at least one wall rail for making contact with the wall (7) of the space and with at least one floor rail (8) for resting on the floor (9) of the space. In order to prevent passage of dust through the separated region of the space, there is least one diagonal brace (36) for detachable mounting on the wall rail (5) and the floor rail (8) outside of the corner region (37) between the wall rail (5) and the floor rail (8) and for applying pressure to the middle region (38) of the wall rail (5) and that the diagonal brace (36) has a length which is greater than half the length of the wall rail (5).

14 Claims, 13 Drawing Sheets

U.S. PATENT DOCUMENTS

| | | | | | |
|---|---|---|---|---|---|
| 3,755,968 | A | * | 9/1973 | Williams | 49/489.1 |
| 4,018,020 | A | * | 4/1977 | Sauer et al. | 52/241 |
| 4,397,127 | A | * | 8/1983 | Mieyal | 52/241 |
| 4,604,844 | A | * | 8/1986 | Mikulas et al. | 52/632 |
| 4,655,019 | A | * | 4/1987 | Rejc | 52/475.1 |
| 4,757,657 | A | * | 7/1988 | Mitchell et al. | 52/241 |
| 4,934,396 | A | * | 6/1990 | Vitta | 135/139 |
| 5,062,871 | A | * | 11/1991 | Lemon, III | 55/385.2 |
| 5,159,793 | A | * | 11/1992 | Deugo et al. | 52/126.1 |
| 5,803,653 | A | * | 9/1998 | Zuffetti | 403/363 |
| 5,924,469 | A | * | 7/1999 | Whittemore | 160/368.1 |
| 5,927,038 | A | * | 7/1999 | Goldberg et al. | 52/632 |
| 6,167,937 | B1 | * | 1/2001 | Williams | 160/40 |
| 6,389,778 | B1 | * | 5/2002 | Strange | 52/745.19 |
| 6,920,724 | B1 | * | 7/2005 | Hundley | 52/167.3 |
| 7,134,444 | B2 | * | 11/2006 | Mintie et al. | 135/131 |
| 2001/0017016 | A1 | * | 8/2001 | Rudduck | 52/481.1 |
| 2004/0065799 | A1 | * | 4/2004 | Whittemore et al. | 248/354.1 |
| 2007/0094941 | A1 | * | 5/2007 | Mintie et al. | 52/63 |
| 2008/0110127 | A1 | * | 5/2008 | Terada et al. | 52/646 |

FOREIGN PATENT DOCUMENTS

| | | | |
|---|---|---|---|
| WO | 2004/016879 | A1 | 2/2004 |
| WO | 2006/002705 | A1 | 1/2006 |

* cited by examiner

DEVICE FOR SEPARATING REGIONS OF A SPACE

BACKGROUND OF THE INVENTION

1. Field of Invention

The invention relates to a device for separating regions of a space with at least one ceiling rail for pressing on the ceiling of the space, with at least one wall rail for making contact with a respective wall of the space and with at least one floor rail for resting on the floor of the space.

2. Description of Related Art

A device of the initially mentioned type is already known from International Patent Application Publication WO2006/002705 A1. In the known device, the individual rails for the ceiling, walls and floor are made such that they can be pushed against one another and relative to one another. The rail parts, which can be telescoped into and out of one another, make it possible to completely separate one region of a space which is to be renovated relative to other regions of a space. The individual rail parts provide a peripheral frame which adjoins the ceiling, the walls and floor and to which a film can be attached in order to enable dirt-proof separation of the regions of the space. The peripheral and closed frame is achieved in the known device by the respective rails being interconnected in their edge regions via corner connectors which, on the one hand, are used to join the transverse rail parts to one another and which are, moreover, designed to apply a certain pressure to the rail parts so that they adjoin the wall, the ceiling and the floor as much as possible without gaps.

SUMMARY OF THE INVENTION

The object of this invention is to further improve the known device for separation of regions of a space.

This object is achieved in a device of the above indicated type in that there is at least one diagonal brace for detachable mounting on the wall rail and the floor rail outside the corner region between the wall rail and the floor rail and for applying pressure to the middle region of the wall rail and that the diagonal brace has a length which is greater than half the length of the wall rail. The diagonal brace in accordance with the invention, which is supported on the floor rail, on the one hand, and the wall rail, on the other hand, and in the installed state acts on the middle region of the wall rail, can ensure that at least there are essentially no gaps in the wall region so that dirt particles in this region cannot pass through between the wall and the wall rail. Otherwise, it goes without saying that the middle region encompasses roughly the middle third of the wall rail and the wall height. So that the diagonal brace can be placed in the middle region of the wall rail to produce the corresponding pressure, it has a length which is greater than half the length of the wall rail.

In order to be able to easily mount the diagonal brace, it is provided that it can be inserted into guides of the floor rail and the wall rail which run lengthwise and can be braced there. Since it can happen for various applications that the wall rail or floor rail has a great length, it is favorable for at least one guide in a rail in the lengthwise direction of the rail to be interrupted between the front end and the back end of the guide and on this interruption to have at least one insertion opening via which the diagonal brace can be inserted into the guide. In this way, it is possible to insert the diagonal brace into the guide not only on the ends of the respective rail, but also on the respective insertion openings. If there is only one insertion opening per rail, it is conventionally roughly in the middle of the rail. For two insertion openings per rail, they are preferably located roughly at ⅓ and ⅔ of the length of the rail.

In order to be able to easily brace the diagonal brace, there is preferably a screw, crimp or clamp connection. Especially a wedge is suited for producing a clamp connection.

In order to have good pressure in the floor region and ceiling region for ensuring good tightness, there is at least one especially vertically adjustable support rod for placement between the floor rail and ceiling rail. The vertical adjustability should be preferably continuously variable, for reasons of handling its being a good idea if the support rod can be fixed in each position by way of a screw connection.

It is advantageous, in this connection, that in the support rod, preferably on at least one end of the support rod, there is at least one spring means which acts in the lengthwise direction of the support rod. This spring means facilitates not only insertion of the support rod, but also ensures permanent pressure on the respective rail. Otherwise, it is recommended that there is at least one corresponding spring means, if not only in the support rod, but also in the diagonal brace.

In order to be able to easily and quickly mount the support rod, it can be provided that the bottom end of the support rod can be locked into the floor rail and/or that the upper end of the support rod can be locked into the ceiling rail. It is preferred if one end of the support rod can be locked into one rail while its other end can be pushed into a corresponding guide of the other rail. More favorably, it is such that the upper rod head of the support rod can be inserted into a guide of the ceiling rail and can be locked in at the other end. In order to enable insertion at various locations and not only on the end of the respective ceiling rail, it is otherwise provided that the guide is interrupted, and at the interruption, there is at least one insertion opening via which the head of the support rod can be inserted into the guide.

In order to ensure relatively good guidance, the head of the support rod has at least one guide projection on each of opposite sides for engaging the guide. Since the guide projections are subject to not inconsiderable loading when inserted into the guide and also in handling, it is recommended that they be made from metal, while the head of the support rod otherwise can consist fundamentally of plastic. In this connection, the guide projections can advantageously be made on spring legs which can be pressed into the rod head against their spring direction. Due to the possibility of pressing the spring legs in, and thus, the possibility of essentially complete countersinking of the guide projections in the head of the support rod, it can be inserted into the guide at this point without the need for an insertion opening.

In order to be able to insert the device in accordance with the invention in the region of roof pitches as well, the support rod head is made such that, in the state inserted into the ceiling rail, pivoting of the ceiling rail relative to the lengthwise direction of the rail on each side by at least 20°, preferably by more than 40° relative to the support rod, is possible. Specifically, this is possible in that the support rod head is beveled or rounded on the top side in the lengthwise direction of the rail. The aforementioned idea, moreover, also has inventive significance.

In the ceiling region there are often cables and cable ducts. To bridge these irregularities there is at least one adapter piece which has an outer brush region. The adapter piece then forms part of the ceiling rail and is attached such that the individual bristles of the brush adjoin the ceiling, forming a seal. In the region of the cable or cable duct, the individual bristles are pressed away without otherwise adversely affecting the sealing function. The brush region should have a height between 1 cm and 5 cm and a length of more than 10 cm. This idea also has inventive significance.

For easy handling of the device in accordance with the invention, it is made as a kit. For this purpose, it is recommended that all parts be kept in a pouch. The pouch should have a length which is only slightly larger than the longest component dimension. It has been established that it is sufficient if the components have a maximum length of 1.5 m, the vertically adjustable support rods in the extended state, of course, having a length of more than 1.5 m.

Otherwise, not only for reasons of costs, but also to make the device in accordance with the invention as light as possible, it is recommended that all components, i.e., all rails, the support rods and the diagonal braces, be produced from plastic.

Other features of the invention will become apparent from the following description of embodiments using the drawings.

BRIEF DESCRIPTION OF THE DRAWINGS

FIG. 14 is a front view of the adapter piece in accordance with the invention.

DETAILED DESCRIPTION OF THE INVENTION

Figure 1:
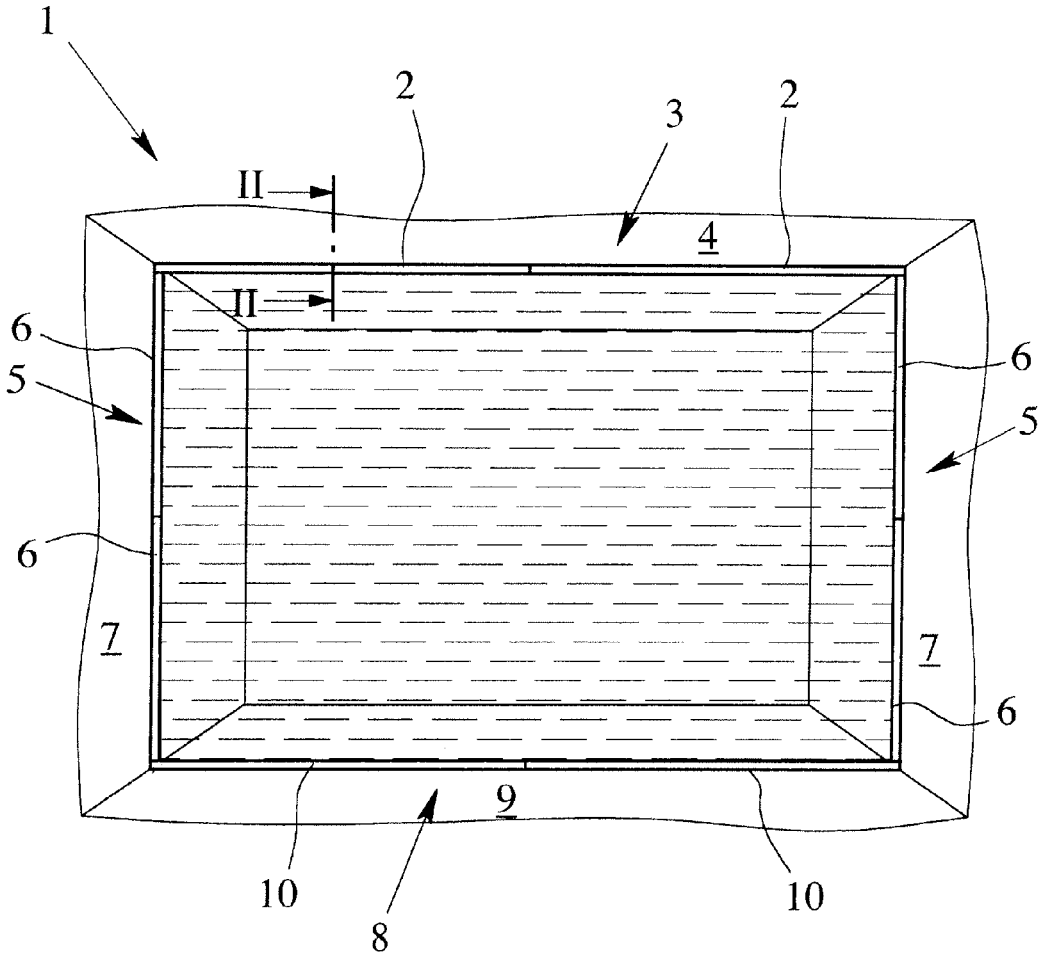
Fig. 1 (Prior Art)
FIG. 1 is a perspective view of one embodiment of the known device.

FIG. 1 shows a device 1 known from International Patent Application Publication WO2006/002705 A1 for separation of regions of a space, with a ceiling rail 3 which has two ceiling rail parts 2 for pressing on the ceiling 4 of the space. Here, the ceiling rail parts 2 have a profile such that adjacent ceiling rail parts can be telescoped into and out of one another. In the illustrated ceiling rail 3, the ceiling rail parts 2 are extended so far relative to one another that the ceiling rail 3 extends over the entire width of the ceiling 4 of the space. In addition, it is intended here that the ceiling rail 3 is pressed against the ceiling 4 of the space over its entire length and thus adjoins the ceiling 4 of the space along the entire length of the ceiling rail 3.

In an embodiment which is not shown, adjacent ceiling rail parts are connected to one another via connecting elements so that a uniform or integral ceiling rail is formed. The connection between the adjacent ceiling rail parts can be such that, in contrast to the above described embodiment, relative displacement between adjacent ceiling rail parts is not possible. Adaptation to the width of the ceiling then takes place by ceiling rail parts which have different lengths and which are provided as a set.

Furthermore, FIG. 1 shows two wall rails 5 for supporting the ceiling rail 3. The wall rails 5 have two wall rail parts 6 which can be telescoped into and out of one another similar to the ceiling rail 3. The wall rail 5, on the one hand, performs the function of pressing the ceiling rail 3 against the ceiling 4 of the space, and on the other hand, serves the purpose of adjoining the walls 7 over the entire length of the wall rail 5.

Moreover, FIG. 1 shows a floor rail 8 for resting on the floor 9 which has two floor rail parts 10 that can also be telescoped into and out of one another. Therefore, FIG. 1 ultimately shows a ceiling rail 3, two wall rails 5 and a floor rail 8 which are mounted together to form a peripheral rectangular frame 11. The dimensions of the frame 11 are chosen such that the rectangular frame peripherally adjoins the ceiling 4, the walls 7 and the floor 9 of the space. In this connection, it is critical that the frame 11 can be easily matched to spaces of different sizes, the rail parts 2, 6, 10 being telescoped into and out of one another such that the length of the ceiling rail 3 and the floor rail 8 corresponds to the distance between the walls 7 and the length of the wall rails 5 corresponds to the height of the walls 7.

It is not shown in particular that, for very large regions of a space to be separated, the rails 3, 5, 8 can also have three and more rail parts 2, 6, 10. Alternatively or in addition, it is of course also possible to use rail parts 2, 6, 10 which have different, preferably standardized, lengths so that depending on the dimensions of the space, rails 3, 5, 8 with different maximum and minimum lengths are available. By using rail parts 2, 6, 10 in a corresponding number and length, ultimately regions of space of any size can be separated. Likewise, it is not shown in particular that the ceiling rail 3, the wall rail 5 and the floor rail 8 are made structurally identical.

Figure 2:
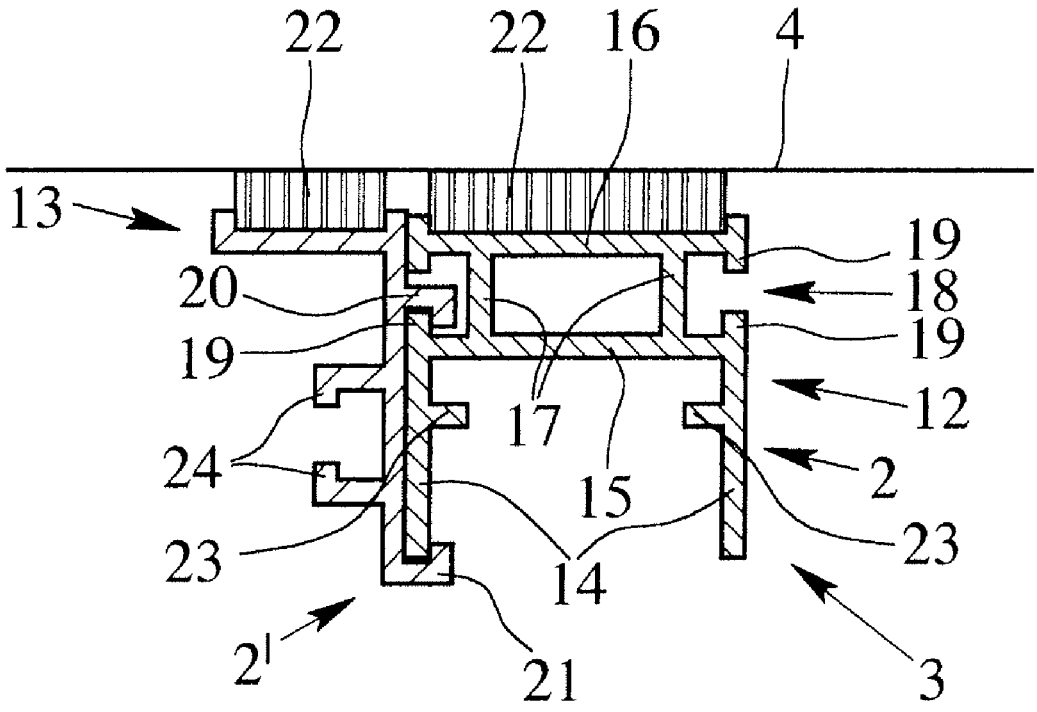
Fig. 2 (Prior Art)
FIG. 2 is a cross-sectional view of the ceiling rail taken along line II-II of FIG. 1, FIGS. 3*a* & 3*b* show a detail of the fixing of the rail parts of the ceiling rail from FIG. 1, FIGS. 4*a* & 4*b* show a side view of a corner connector in the mounted state.

FIG. 2 shows an embodiment of the ceiling rail 3 in a cross-sectional view taken along the line II-II in FIG. 1. The illustrated structure of the ceiling rail 3 corresponds identically to the structure of the wall rail 5 and the floor rail 8. The illustrated ceiling rail 3 consists of two different ceiling rail parts 2, 2', a base profile 12 and a connecting profile 13 being involved. The base profile 12 is essentially a U-shaped profile, the shape being formed by two braces 14 which are located on the outer lengthwise sides and one cross brace 15 which connects the two braces 14. Parallel to the cross brace 16 there is another cross brace 16 which is connected to the cross brace 15 via stems 17 which are located at right angles to the cross brace 16. The stems 17 and the braces 14 are spaced apart from one another in the lengthwise direction. Since the cross brace 16 is likewise spaced away from the braces 14, a groove 18 which runs along the lengthwise direction of the base profile 12 results. On each of the outside edges of the groove 18, there are two projections 19 which face toward one another and which ultimately are used for one of the hook-shaped projections 20 of the connecting profile 13 to engage the groove 18 of the base profile 12, while the hook-shaped projection 21 extends around the free end of the adjacent brace 14. Thus, the profiles 12, 13 are connected to be able to be telescoped into and out of one another.

Figure 11:
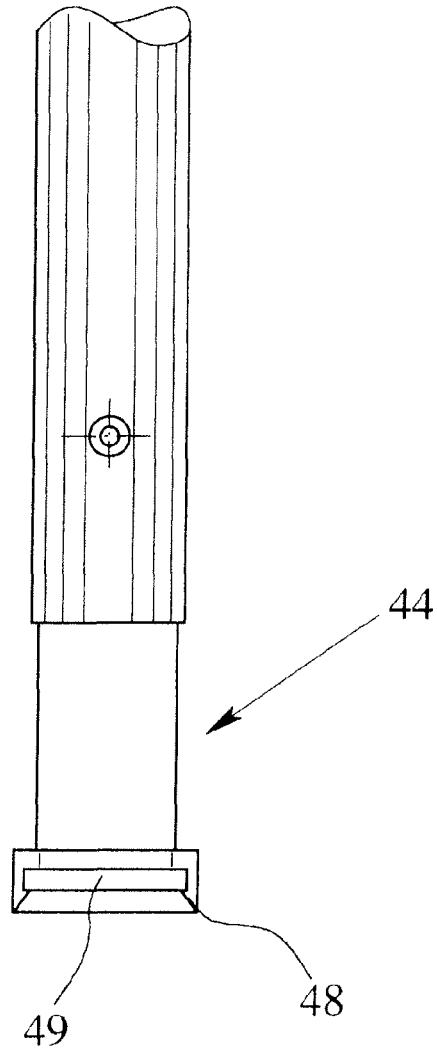
FIG. 11 is a side view of the lower end of the support rod from FIG. 10.

The connecting profile 12 has essentially the shape of an L, on the outside on one leg there being a sealing means 22 which extends over the entire lengthwise extension of the connecting profile 13. The base profile 12 on the outside on the brace 15 also has a sealing means 22 which extends over the entire length of the base profile 12. The sealing means can be an adhesive strip of foamed plastic which lies with its adhesive side on the respective rail. The arrangement of the sealing means 22 which are located, likewise, in the manner shown in FIG. 2 for the wall rail 5 and the floor rail 8, leads to the rails 3, 5, 8 for the embodiment shown in FIG. 1 directly adjoining the ceiling 4 of the space, the walls 7 and the floor 9. Therefore, between the ceiling of the space, the walls 7, the floor 9 and the rectangular frame 11 which is shown in FIG. 11 there are no gaps at all through which fine dirt can penetrate.

To connect the base profile 12 to elements which are still to be explained, there are extensions 23 which extend along the length of the braces 14. Conversely, the prolongations 24 are used mainly to increase the stiffness of the connecting profile 13 and to support a fastening means 25. For the base profile 12 shown in FIG. 2, it is possible to attach at least one connecting profile 13 each on the two lengthwise sides.

Figure 3A:
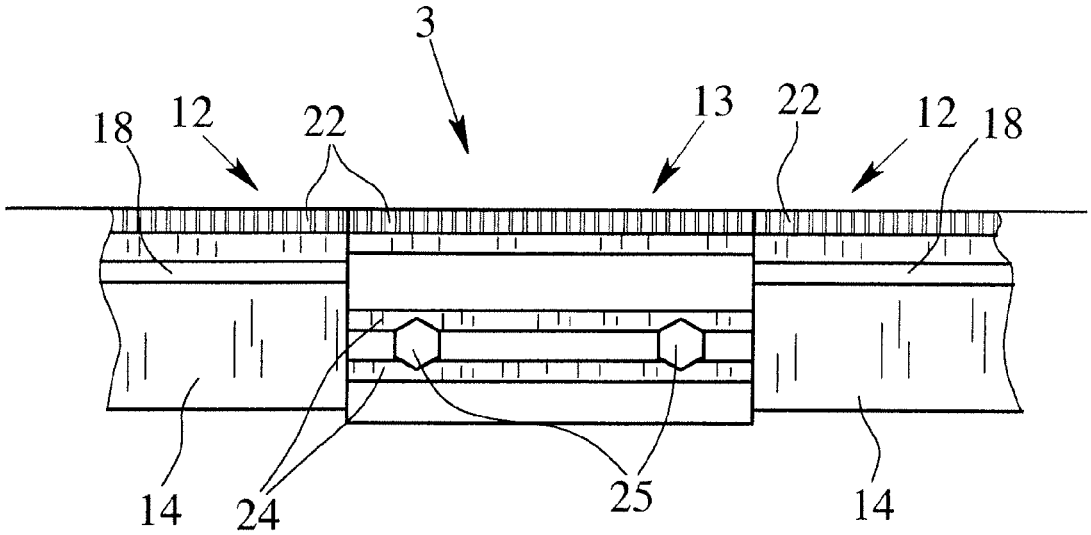
Fig. 3a (Prior Art)
Figure 3B:
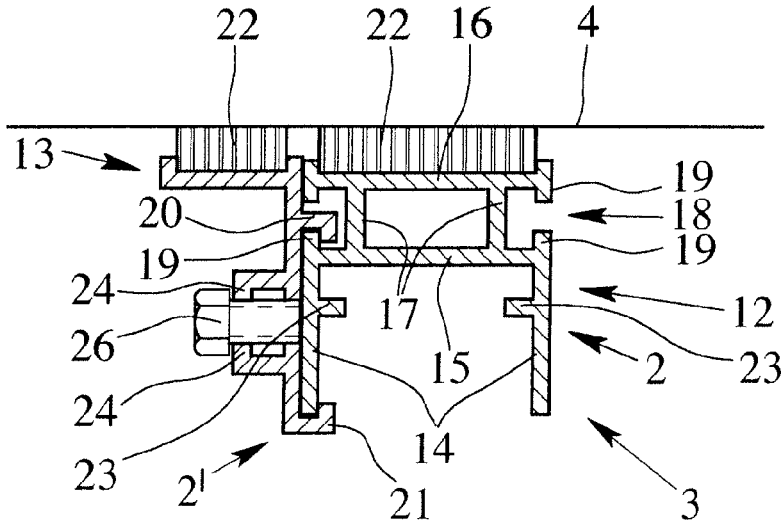
Fig. 3b (Prior Art)

FIGS. 3*a* and 3*b* show, using the example of a ceiling rail 3, the fastening of the rail parts 2, 6, 10 to one another; this attachment can be provided fundamentally for all of the rails 3, 5, 8 in the same way. FIG. 3*a* shows a connecting profile 13 with two attachment means 25 by which a respective base profile 12 is fixed relative to the connecting profile 13 in order to prevent unintentional telescoping of the base profile 12 and the connecting profile 13 into and out of one another. Fixing of the profiles 12, 13 by means of a stud screw 26 is shown in particular in FIG. 3*b*.

Figure 4A:
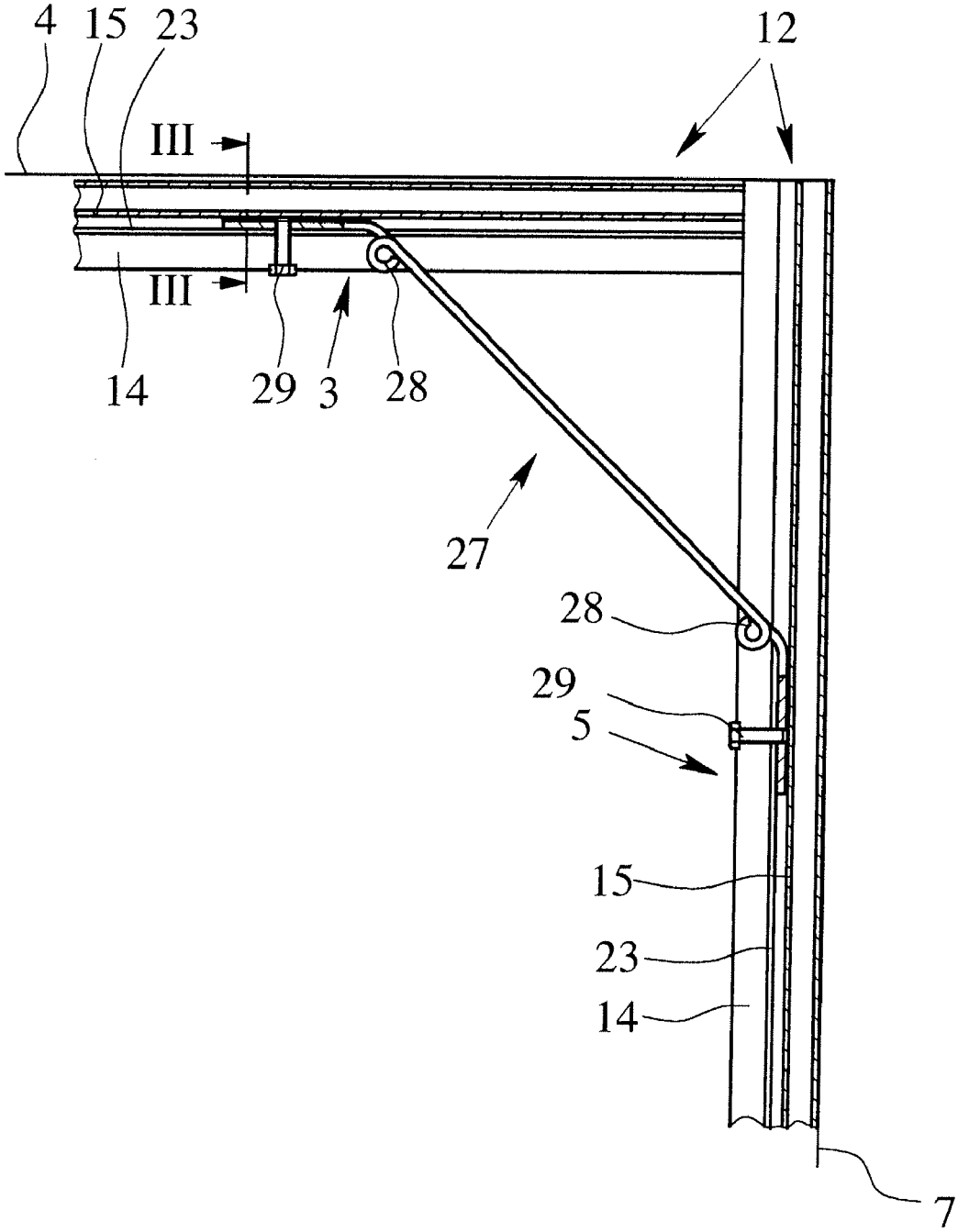
Fig. 4a (Prior Art)
FIG. 4*c* is a cross-sectional view of a wall rail and a corner connector taken along line III-III in FIG. 4*a*.
Figure 4B:
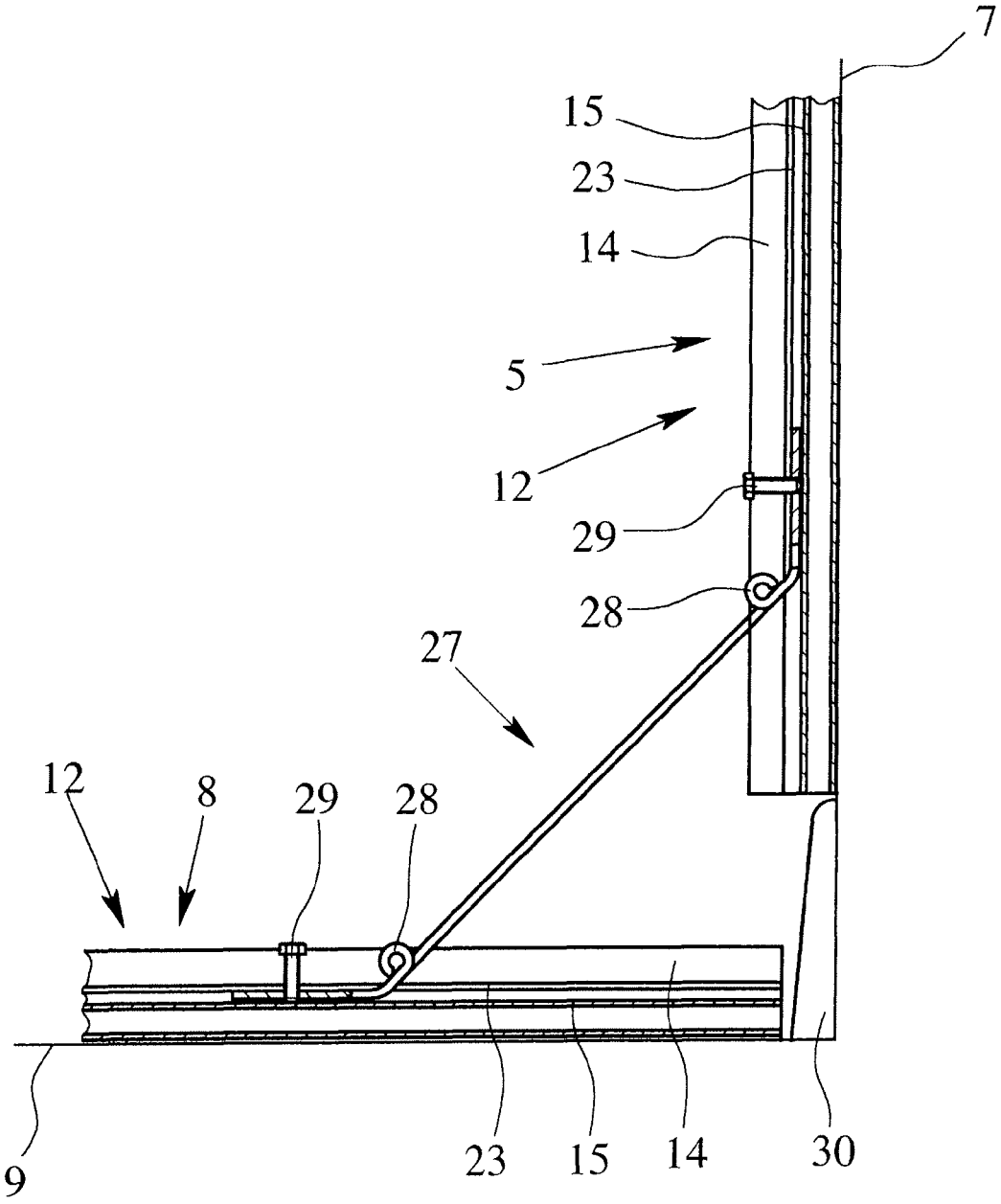
Fig. 4b (Prior Art)
Figure 4C:
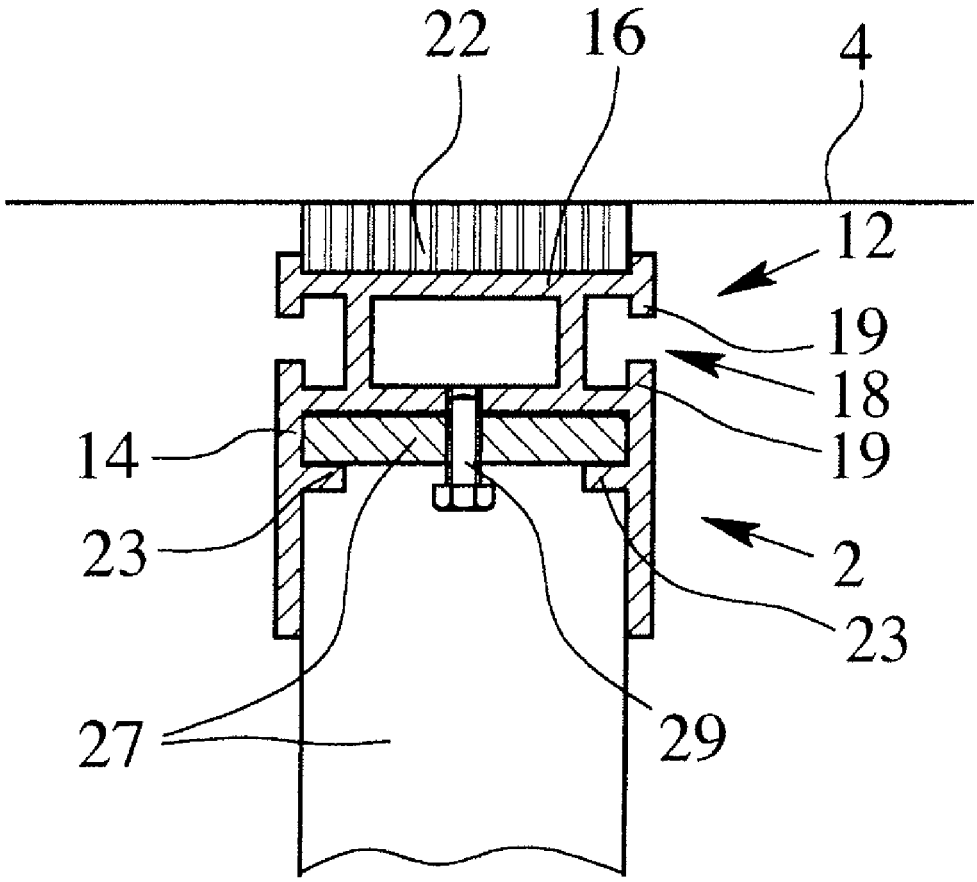
Fig. 4c (Prior Art)

FIGS. 4*a* and 4*b* show the connection of two rails 3, 5; 5, 8, respectively, via a corner connector 27. It is not shown in particular that there can be a corner connecter 27 in all four corners of the frame 11. Here fundamentally, there is no difference in whether the wall rail 5 is connected to a ceiling rail 3 or a floor rail 8. The corner connector 27 which is shown in FIG. 4*a* has two spring means 28 which press the ceiling rail 3 and the wall rail 7 apart from one another and thus against the bordering corner formed from the ceiling 4 of the space and the wall 7. Furthermore, FIG. 4*a* shows that the ceiling rail 3 and the wall rail 5 are pushed so far apart from one another that their ends touch and seal the corners between the ceiling 4 of the space and the wall 7". To connect the corner connector 27 to the rail 3, 5, 8, the lengthwise ends of the corner connector 27, as shown in FIG. 4*c*, are pushed between the cross brace 15 and the extensions 23, after which the stud screw 29 is tightened. The corner connectors 27 can thus be located almost anywhere along the base profile 12. This enables the frame 11 to also be easily mounted when on the walls 7 there are, for example. floor strips 30 or the like, as is shown in FIG. 4*b*.

Figure 5:
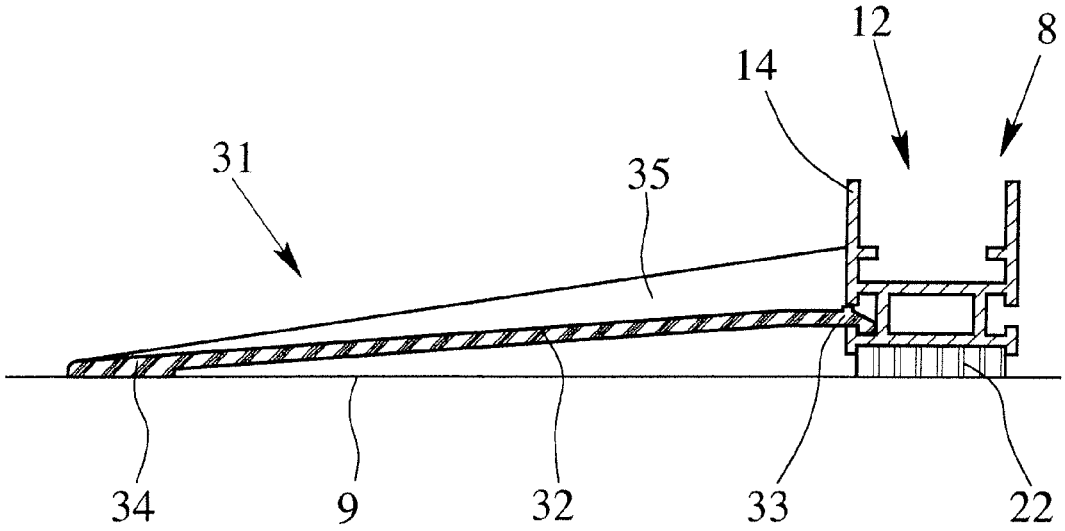
Fig. 5 (Prior Art)
FIG. 5 is a cross-sectional view of the floor rail from FIG. 1 in the state which is connected to the foot part.

FIG. 5 shows a foot part 31 which is connected to the floor rail 8 for mounting the frame 11. The foot part 31 has an essentially rectangular base element 32 with a projection 33 on the transverse side for engaging the groove 18. The connection between the foot part 31 and the floor rail 8 takes place either by hanging or pushing the projection 33 into the groove 18 of the floor rail 8. In the transverse side of the foot part 31 facing away from the projection 3, there is a flattened section 34 which establishes contact between the foot part 31 and the floor 9. The two transverse sides of the foot part are spaced roughly 1.4 m apart from one another. During mounting of the frame 11, the floor rail 8 is supported on the support element 35 which projects transversely relative to the base element 32.

Figure 6:
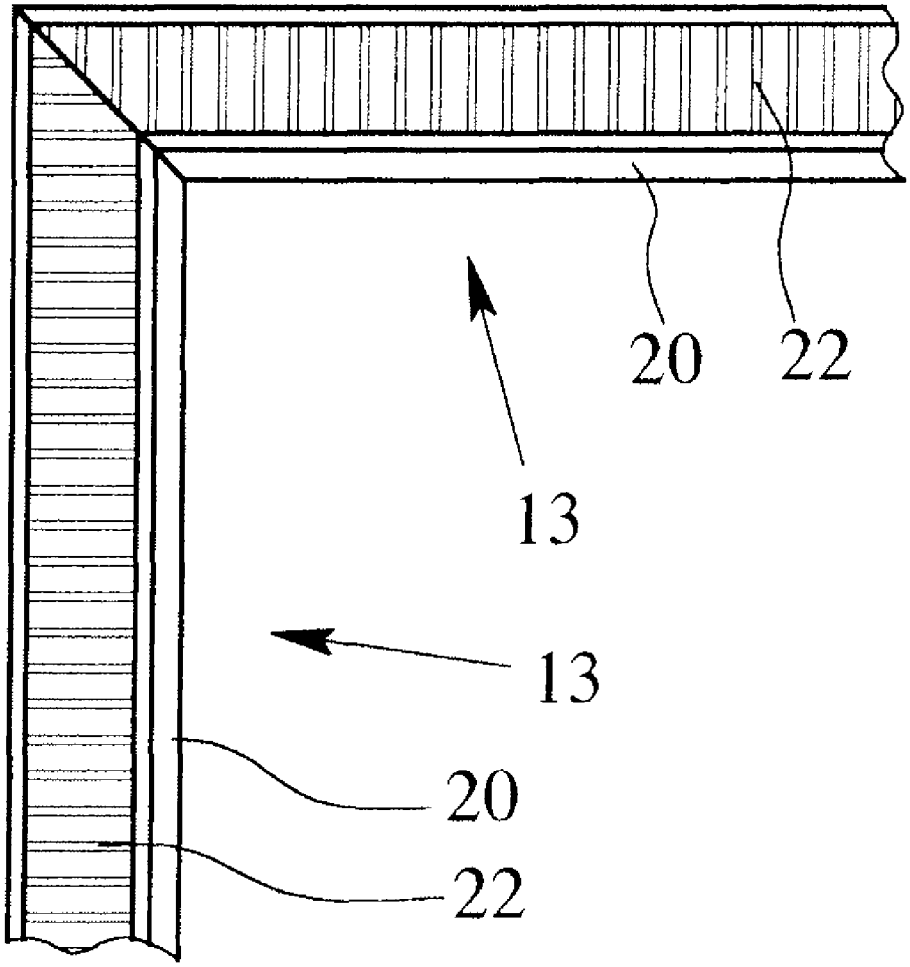
FIG. 6 is a plan view of one preferred embodiment of the ceiling rail part.

To separate the regions of space via the corner, i.e., for separating the regions of space by means of barriers which have two sides which are preferably at a right angle to one another, the connecting profiles 13 which are shown in a plan view in FIG. 6 are used. These connecting profiles 13 on a lengthwise-side end have a miter joint angled at roughly 45° so that the two rails 3, 5; 5, 8, form an angle of 90° when their miter ends are brought into engagement with each other.

Figure 7:
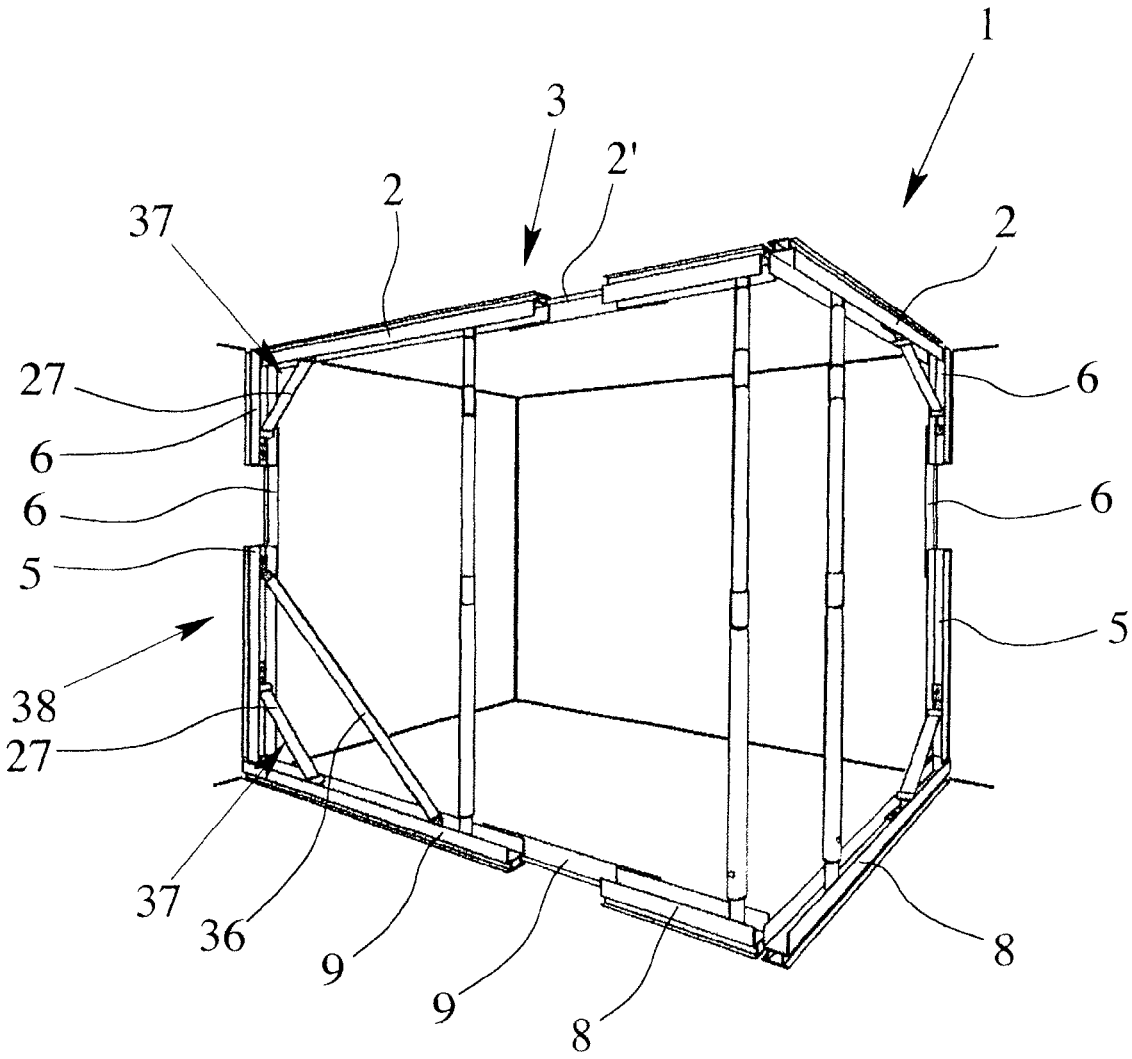
FIG. 7 is a perspective view of a device in accordance with the invention.

The device 1' of the present invention shown in FIG. 7 corresponds in terms of its basic components and structure at least essentially to the embodiments shown in FIGS. 1 to 6. Thus, reference is made expressly and in full scope to the above to avoid repetitions, and the same reference numerals have been used for corresponding parts to facilitate such reference.

For the device 1' which is shown in FIG. 7, there is at least one diagonal brace 36 for detachable mounting on the wall rail 5 and the wall rail part 6, on the one hand, and the floor rail 8 and the floor rail part 9 on the other, the diagonal brace 36 outside of the corner region 37 between the wall rail 5 and the floor rail 8 being intended for applying a pressure force to the middle region 38 of the wall rail 5. Therefore, the diagonal brace is provided to supplement the corner connectors 27 and provides sufficient pressure of the wall rail 5 against the wall 7 in the region between the corner connectors 27. To be able to ensure this, the diagonal brace 36 is several times longer than the corner connectors 27, and moreover, has a length which is greater than half the length of the entire wall rail 5. In this way, it is ultimately ensured that the diagonal brace 36 can be mounted roughly at an angle between 40° and 50° between the floor rail 8 and the wall rail 5 and can act on the middle region of the wall rail 5.

Figure 8:
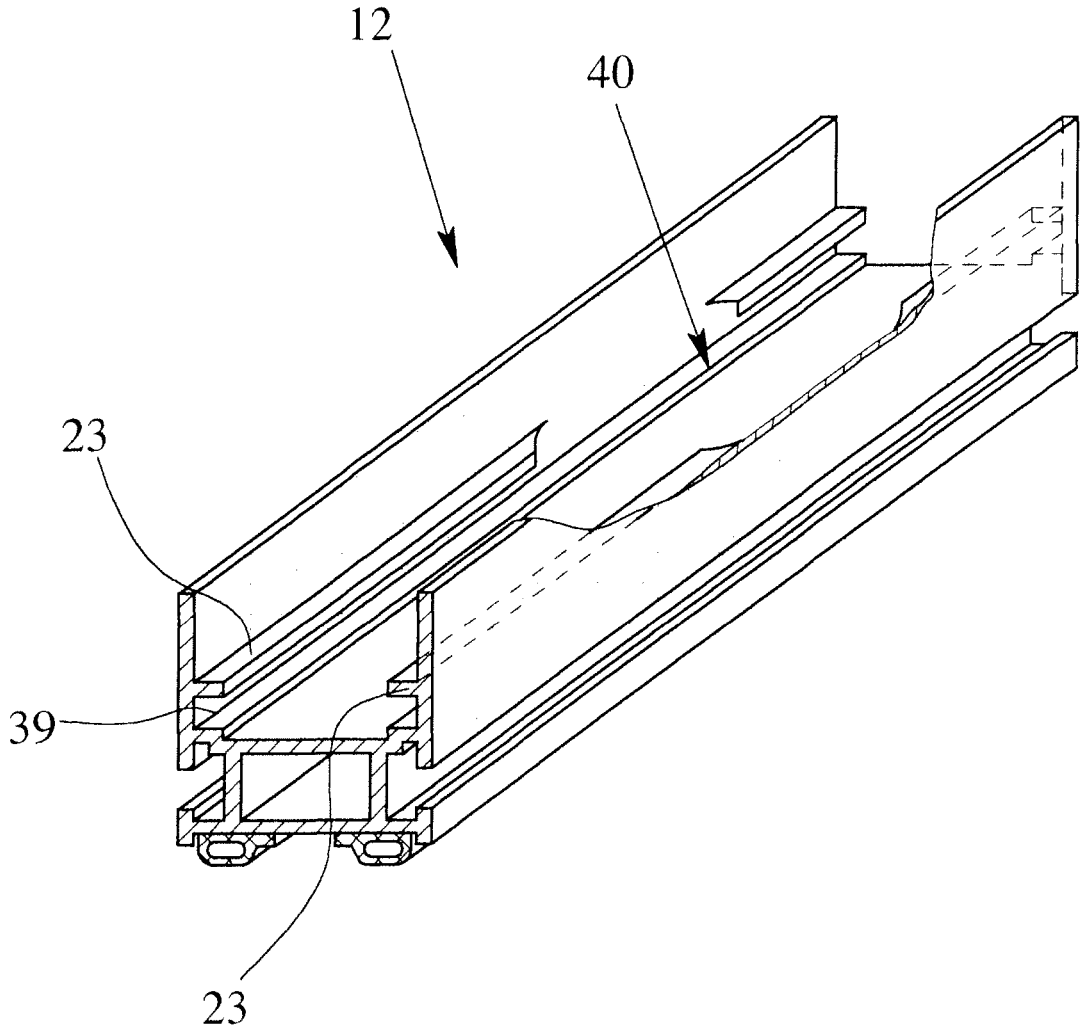
FIG. 8 is a perspective front view of the rail profile.

FIG. 8 shows a base profile 12 which is used for the ceiling rail 3, the wall rail 5 and the floor rail 8. Underneath the extensions 23, there is a guide 39 which runs lengthwise and into which the diagonal brace 36 can be inserted at its end and can be braced there. As otherwise follows from FIG. 8, the guide 39 is interrupted on opposite sides roughly in the middle region. In the region of this interruption, there are no extensions 23 so that an insertion opening 40 is formed there.

Figure 9:
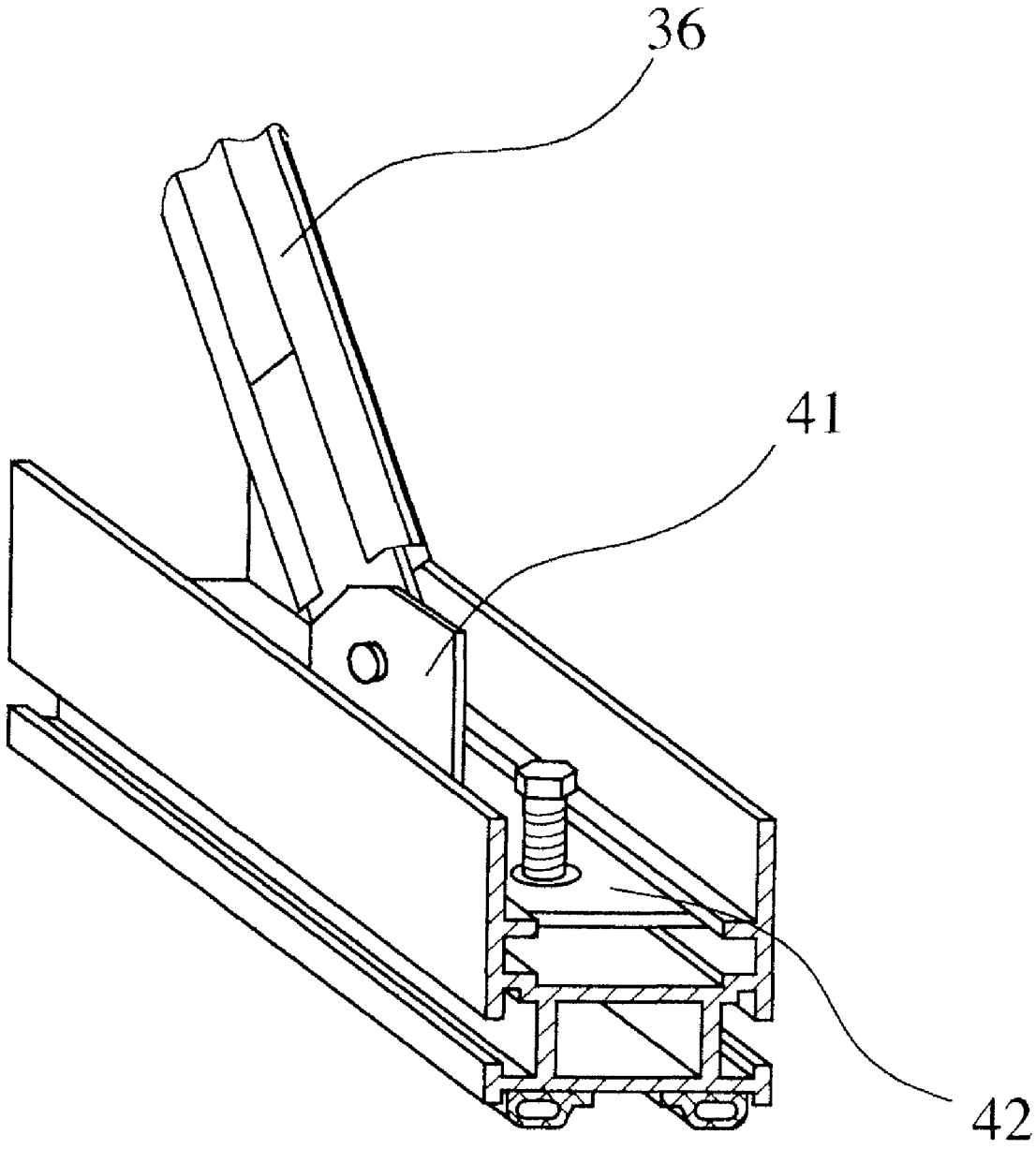
FIG. 9 is a perspective view of a diagonal brace which is inserted into a rail part.

FIG. 9 shows that an end of the diagonal brace 36 has a coupled segment 41 with a guide plate 42, and the guide plate 42 can be inserted into the guide 39. Different angle positions can be set via the coupled section 41. To brace the diagonal brace 36, the guide plate 42 can be screwed into the guide or, for example, can be clamped via a wedge.

Otherwise, the device 1' shown in FIG. 7 has at least one support rod 43 (FIG. 10) for arrangement between the floor rail 8 and the ceiling rail 2. In the illustrated embodiment, there are three support rods 43. Each of the support rods 43 is telescopic and can be continuously adjusted in length via a corresponding connection. Locking takes place via twisting of the individual telescoping parts of the support rods relative to one another. Release takes place by turning in the opposite direction.

Figure 10:
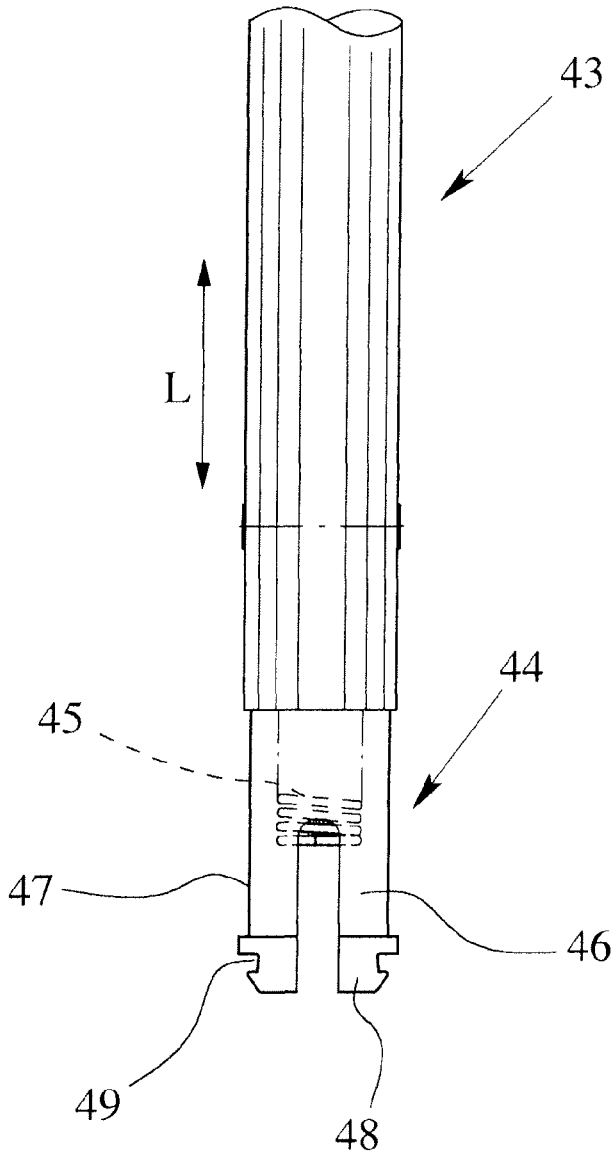
FIG. 10 is a front view of the lower end of the support rod.

FIG. 10 shows that the support rod 43 has a spring means 45 on its lower end 44 which acts in the lengthwise direction L. It is a helical spring which presses the lower end 44 to the outside. Otherwise, the lower end 44 of the support rod 43 can be locked into the floor rail 8 or the base profile 12. For this purpose, the lower end 44 has two catch legs 46, 47, on whose ends there is a catch head 48 with catch receivers 49. The two receivers 49 are used to engage the extensions 23 in the base profile 12. As a result of the catch connection, the lower end 44 of the support rod 43 can be locked anywhere in the base profile 12. For later removal from the base profile 12 it is necessary to push the support rod 43 either as far as one end of the base profile 12 or to remove the lower end 44 on one insertion opening 40.

Figure 12:
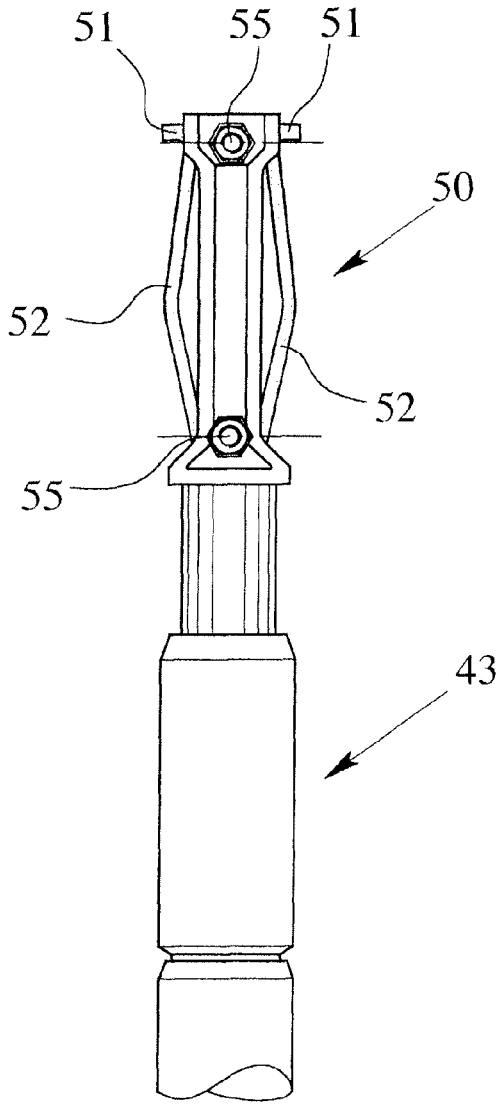
FIG. 12 is a front view of the head of the support rod.
Figure 13:
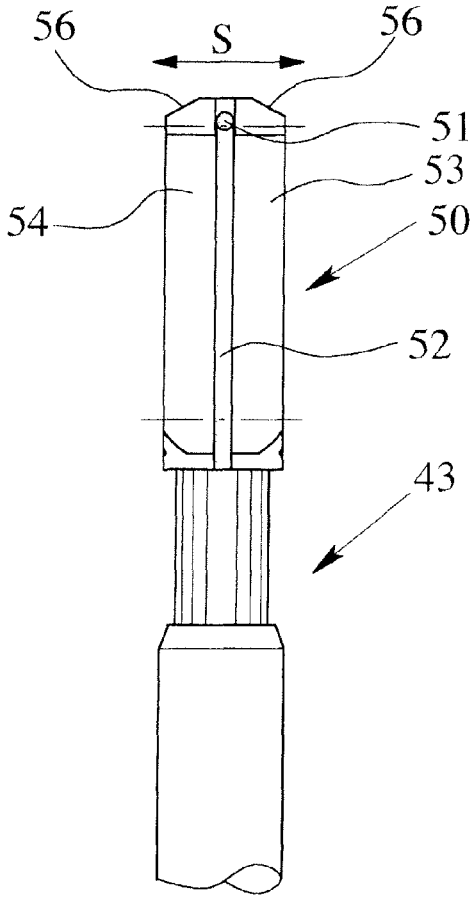
FIG. 13 is a side view of the head of the support rod from FIG. 9
Figure 1:
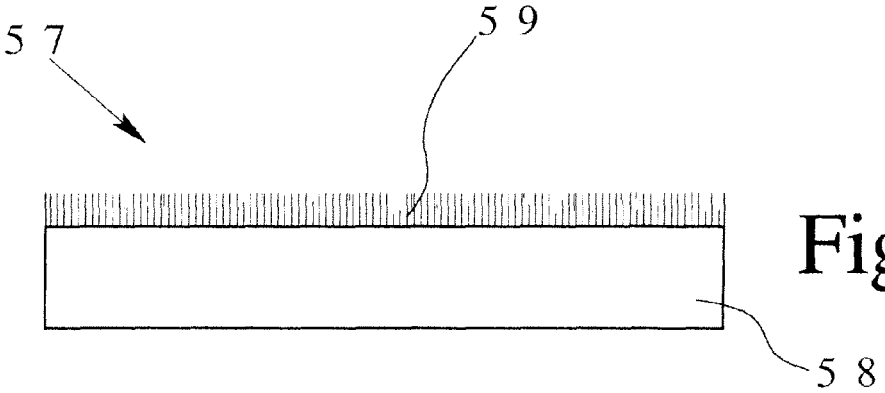

In FIGS. 12 and 13, the upper head 50 of the support rod 43 is shown. The upper head 50 of the support rod 43 can be inserted into the guide 39 of the base profile 12. Insertion can take place from the end of the base profile 12 or from the insertion opening 40, as has been described above. The support rod head 50 has a guide projection 51 on each on of opposite sides for engaging the guide 39. In the illustrated embodiment, guide projections 51 are made on the spring legs 52. The two spring legs 52 form a roughly U-shaped spring which is bulged in the middle region. In this way, it is possible to press the two spring legs 52 toward one another so that the outer ends of the guide projections 51 are held in the support rod head 50 and do not project from it. This makes it possible to insert the support rod head 50 anywhere into the base profile 12, since the width of the support rod head 50 is smaller than the distance of the opposite extensions 23 in the base profile 12. Ultimately, the support rod head 50 is formed of two head profiles 53, 54 which are screwed to one another via screw connections 55 with simultaneous fixing of the springs which have the spring legs 52.

Otherwise the support rod head 50 is made such that, in the state inserted into the ceiling rail 3, pivoting of the ceiling rail 3 relative to the lengthwise direction S of the rail is possible on each side by at least 20°, preferably by more than 40°. For this purpose, the support rod head 50 is provided with a bevel 56 which descends to the outside to each side. The respective bevel 56 comes to rest ultimately on the bottom of the guide or the cross brace 15 for an oblique position of the base profile 12.

FIG. 14 schematically shows an adapter piece 57 which can be placed or attached as a profile part on the base profile 12. The adapter piece 57 has a profile piece 58 on whose outside there is a brush region 59. The length of the adapter piece 57 should be greater than 10 cm, while the brush region 59 should have a height greater than 2 cm. The brush region 59 is composed of individual bristles which lie against the floor, the wall or the ceiling in the installed state, forming a seal. Therefore, the thickness of the brush region should be greater than 0.5 cm.

What is claimed is:

1. Device for separating regions of a space, comprising:

at least one ceiling rail for pressing on a ceiling of the space, at least one wall rail for making contact with a respective wall of the space, at least one floor rail for resting on the floor of the space, at least one diagonal brace for detachable mounting on the at least one wall rail and the floor rail outside of a corner region between the wall rail and the floor rail for applying pressure to a middle region of the wall rail, the at least one diagonal brace having a length which is greater than half of the length of the wall rail, wherein the at least one floor rail and the at least one wall rail have at least one lengthwise running guide wherein the at least one lengthwise running guide is interrupted in a manner forming at least one insertion opening via which the at least one diagonal brace is insertable into the at least one lengthwise running guide, and wherein an end of the at least one diagonal brace has a coupled segment with a guide plate for insertion into the guide.

2. Device as claimed in claim 1, further comprising at least one spring means in at least one end of the at least one diagonal brace, the at least one spring means acting in the lengthwise direction of the at least one diagonal brace.

3. Device as claimed in claim 1, further comprising at least one adapter piece for bridging irregularities, the adapter piece having an outer brush region.

4. Device as claimed claim 1, wherein the device is made as a kit for variable assembly adapted to regions of a space of various sizes.

5. Device as claimed in claim 1, wherein the rails and the at least one diagonal brace are made of plastic.

6. Device as claimed in claim 1, wherein each of the rails each comprises a plurality of telescopic rail parts which are able to be telescoped into and out of one another.

7. Device as claimed in claim 1, further comprising corner connectors, wherein the at least one wall rail comprises two wall rails, and wherein the at least one ceiling rail comprises a ceiling rail and wherein the ceiling rail, two wall rails and the floor rail are connectable to one another via the corner connectors to form a peripheral self-supporting frame.

8. Device for separating regions of a space, comprising:

at least one ceiling rail for pressing on a ceiling of the space, at least one wall rail for making contact with a respective wall of the space, at least one floor rail for resting on the floor of the space, at least one diagonal brace for detachable mounting on the at least one wall rail and the floor rail outside of a corner region between the wall rail and the floor rail for applying pressure to a middle region of the wall rail, the at least one diagonal brace having a length which is greater than half of the length of the wall rail, and at least one vertically adjustable support rod for placement between the ceiling rail and the floor rail, wherein a bottom end of the support rod is lockable into the floor rail and wherein the upper end of the support rod is lockable into the ceiling rail.

9. Device as claimed in claim 8, further comprising at least one spring means in at least one end of the support rod, the at least one spring means acting in the lengthwise direction of the support rod.

10. Device for separating regions of a space, comprising:

at least one ceiling rail for pressing on a ceiling of the space, at least one wall rail for making contact with a respective wall of the space, at least one floor rail for resting on the floor of the space, at least one diagonal brace for detachable mounting on the at least one wall rail and the floor rail outside of a corner region between the wall rail and the floor rail for applying pressure to a middle region of the wall rail, the at least one diagonal brace having a length which is greater than half of the length of the wall rail, and at least one vertically adjustable support rod for placement between the ceiling rail and the floor rail, wherein the at least one ceiling rail has at least one lengthwise running guide and wherein a head of the support rod is insertable into the at least one lengthwise running guide of the ceiling rail.

11. Device as claimed in claim 10, wherein the support rod head has at least one guide projection on each of opposite sides for engaging the at least one lengthwise running guide.

12. Device as claimed in claim 11, wherein the at least one guide projection is provided on spring legs which are pressable into the support rod head against their spring force.

13. Device as claimed claim 12, wherein the support rod head is pivotable relative to the ceiling rail, in an inserted state thereof, by at least 20° in both directions relative to the lengthwise direction of the ceiling rail.

14. Device as claimed in claim 13, wherein the support rod head has at least one bevel or rounding on a lengthwise end of the rail for enabling the pivotable movement thereof relative to the ceiling rail.

* * * * *